United States Patent [19]

Brown

[11] 4,137,590

[45] Feb. 6, 1979

[54] DEVICE FOR SCRUBBING CARPET

[75] Inventor: Robert S. Brown, Spartanburg, S.C.

[73] Assignee: Milliken Research Corporation, Spartanburg, S.C.

[21] Appl. No.: 821,188

[22] Filed: Aug. 2, 1977

[51] Int. Cl.[2] ..... A47L 11/34; A47L 11/162

[52] U.S. Cl. ..... 15/50 R; 15/180

[58] Field of Search ..... 15/49 R, 50 R, 98, 320, 15/385, 41 R, 180

[56] References Cited

U.S. PATENT DOCUMENTS 3,055,031 9/1962 Rachlin ..... 15/50 R 3,064,292 11/1962 Fillery ..... 15/50 R 4,019,662 4/1977 Dana ..... 222/414

*Primary Examiner*—Edward L. Roberts

*Attorney, Agent, or Firm*—Robert S. Alexander; H. William Petry

[57] ABSTRACT

A device for scrubbing carpets having a scrubber which rotates about a point which is driven in a circle wherein the scrubber is pivotably mounted on a frame and the weight of the device is supported by the scrubber and two wheels at the rear of the frame. A press bar may be included at the front of the machine for pressing powdered cleaning composition into the carpet.

5 Claims, 17 Drawing Figures

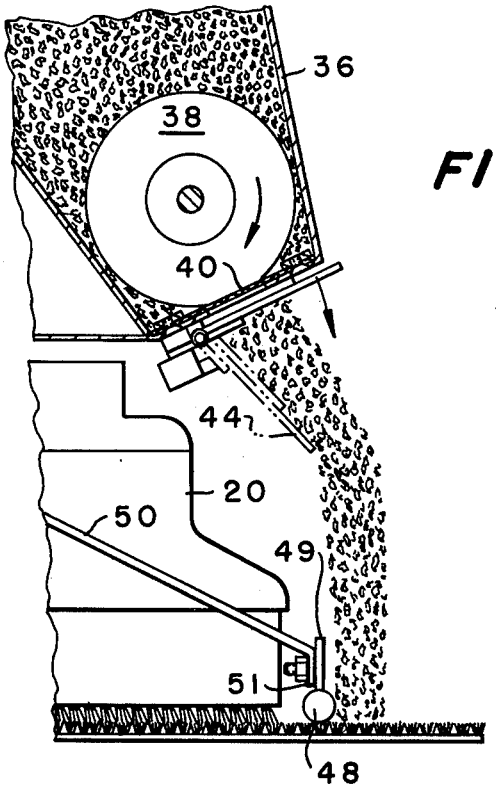
FIG.-5-
FIG.-6-
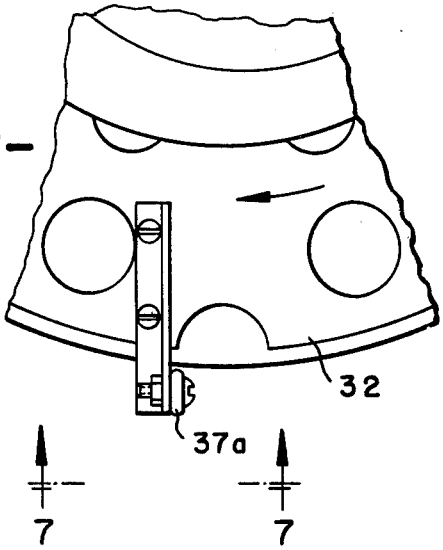
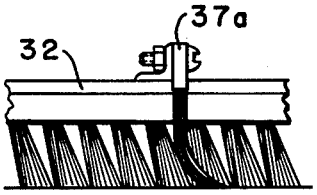
FIG.-7-
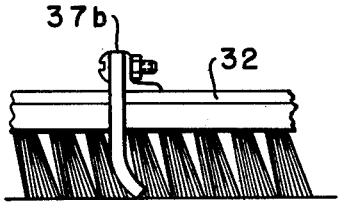
FIG.-9-
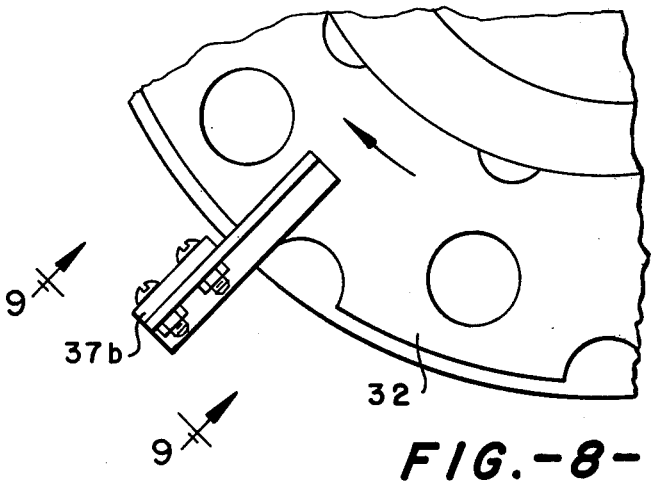
FIG.-8-

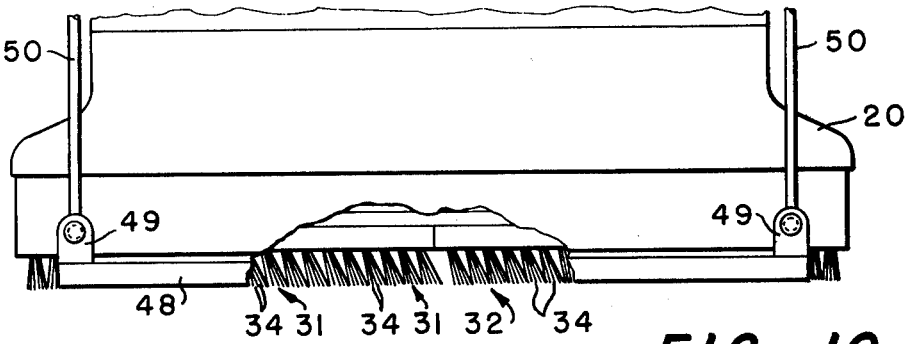
FIG.-10-
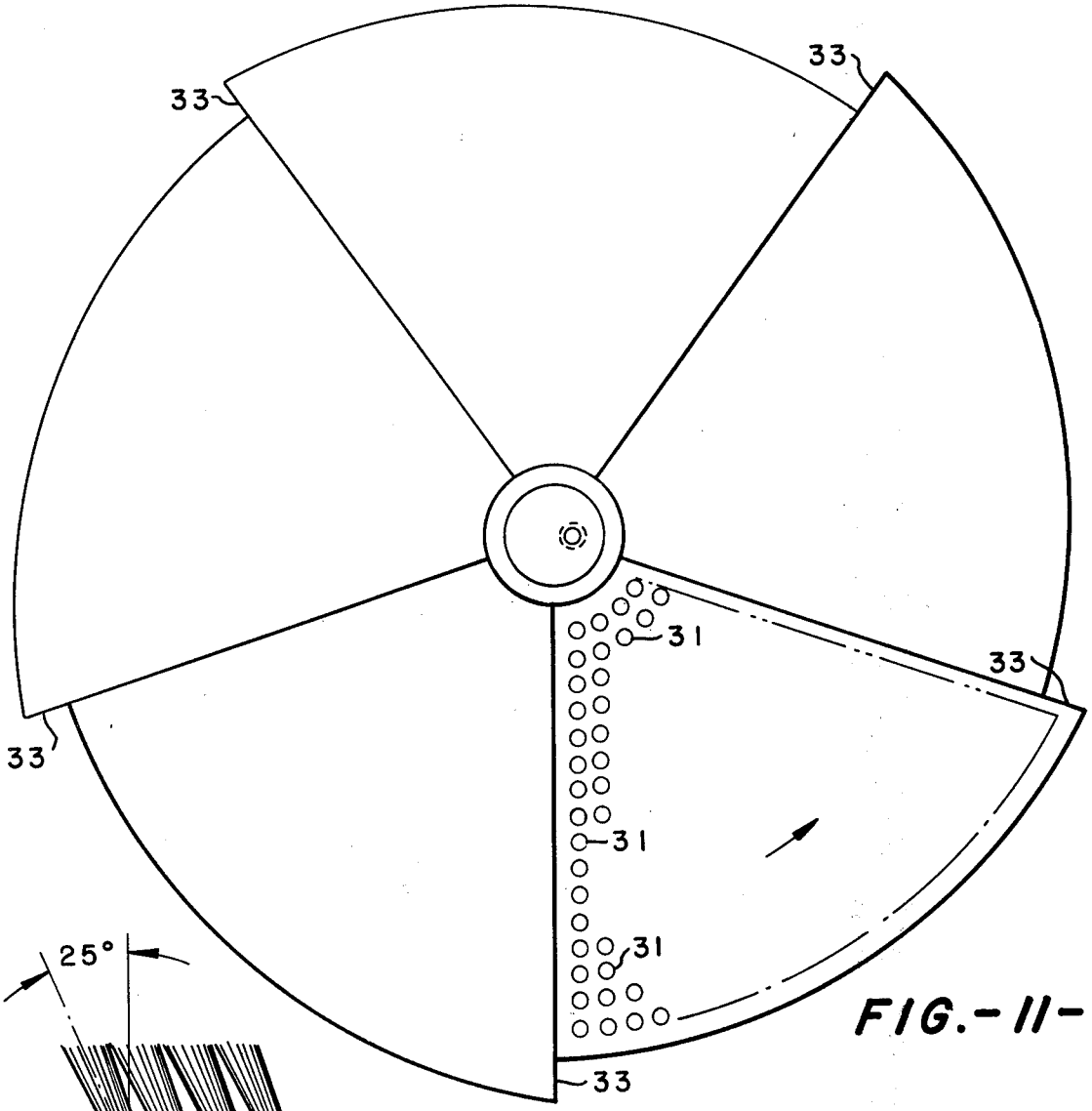
FIG.-11-
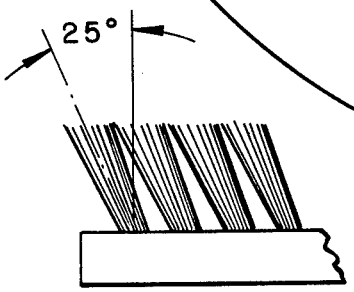
FIG.-12-
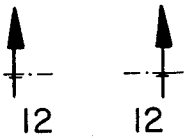

DEVICE FOR SCRUBBING CARPET

Many consider wall-to-wall carpeting to be the peak of luxury; housewives love it for the warm atmosphere it brings, businessmen value it for the air of corporate dignity it lends their offices; but to those who must clean and maintain it, wall-to-wall carpeting is an immense headache. It must be cleaned in place; the cleaning must be accomplished in a relatively short time and if the carpet is not kept scrupulously clean, its life may be severely shortened. For these reasons, the carpet cleaning industry is constantly seeking improved methods and machinery for cleaning carpets.

Recently, a radically new approach to cleaning carpets has been developed which uses a powdered cleaning composition containing a mixture of extremely porous solid particles and a solvent. This new cleaning composition is described in U.S. Pat. No. 4,013,594 and has proved especially effective in removing soil from carpets. Further, only a short interval is required between application and removal of the powdered cleaning composition. Using this new cleaning composition, it has now become possible to clean wall-to-wall carpets in offices and stores during working hours with little disruption of normal affairs. However, this progress in cleaning compositions has exposed shortcomings in the carpet cleaning machines known to the prior art.

When the devices which are known to the prior art are used with this new powdered cleaning composition, it is found that some areas of the carpet are cleaned much better than other areas and that a streaked appearance results. It is theorized that this streaked appearance is due to the fact that the powder, unlike a liquid, must be physically moved into intimate contact with the fibers to be cleaned; therefore, to obtain the full benefit of the powdered cleaning composition, it is thought to be desirable to provide a device which is capable of transmitting a great deal of energy to the carpet in order to bring the powdered cleaning composition into intimate contact with the fiber while distributing this energy uniformly over the area which is scrubbed. Further, it is desirable to provide a device which does not redistribute the powder which has been applied to the carpet.

It is therefore an object of this invention to provide a device which is capable of transmitting energy to the carpet uniformly. It has been found that this object can be accomplished by providing a device of the type having a scrubber which rotates about a point which is driven in a circle wherein the scrubber is pivotally mounted on a frame and the weight of the device is supported by the scrubber and two wheels at the rear of the frame. Means for pressing powdered cleaning composition into the carpet may be mounted on the frame.

BRIEF DESCRIPTION OF THE DRAWINGS

FIG. 5 is an enlarged schematic side elevation of the front of the machine, partly in section, showing the manner in which powder is dispensed, and pressed into the powder if the optional press bar is used.

FIG. 6 is a top schematic view of a rider brush attached to the main scrubbing element for pressing powdered cleaning composition into the carpet.

FIG. 7 is a view taken along line 7—7 of FIG. 6.

FIG. 8 is a top schematic view of a flexible wiper attached to the main scrubbing element for pressing powdered cleaning composition into the carpet.

FIG. 9 is a view taken along line 9—9 of FIG. 8.

FIG. 10 is a partial front elevation, partly cutaway, of the carpet scrubbing machine.

FIG. 11 is a schematic bottom view of the most preferred brush for use with the machine of the present invention.

FIG. 12 is a view taken along line 12—12 of FIG. 11 showing the lie of the bristles.

DESCRIPTION OF THE PREFERRED EMBODIMENT

Figure 1:
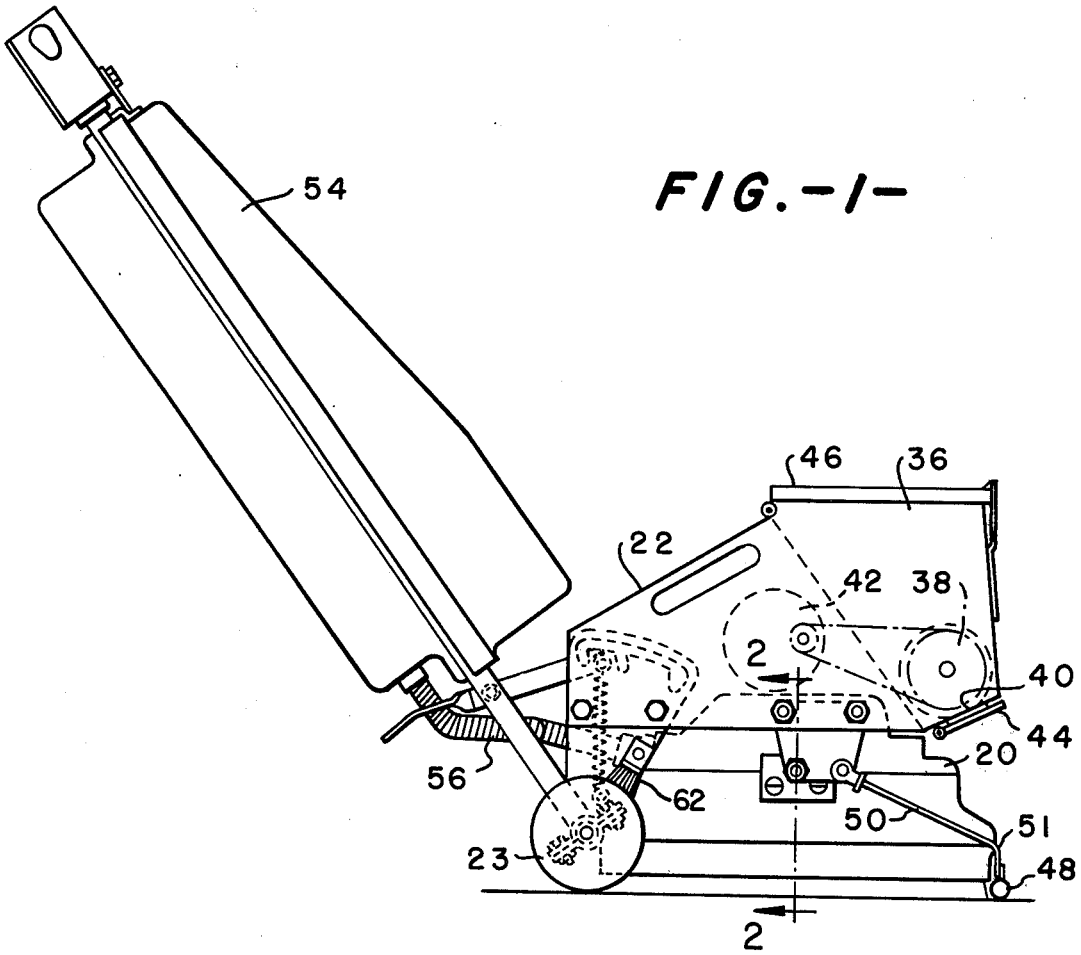
FIG. 1 is a side elevation of the carpet scrubbing machine.
Figure 2:
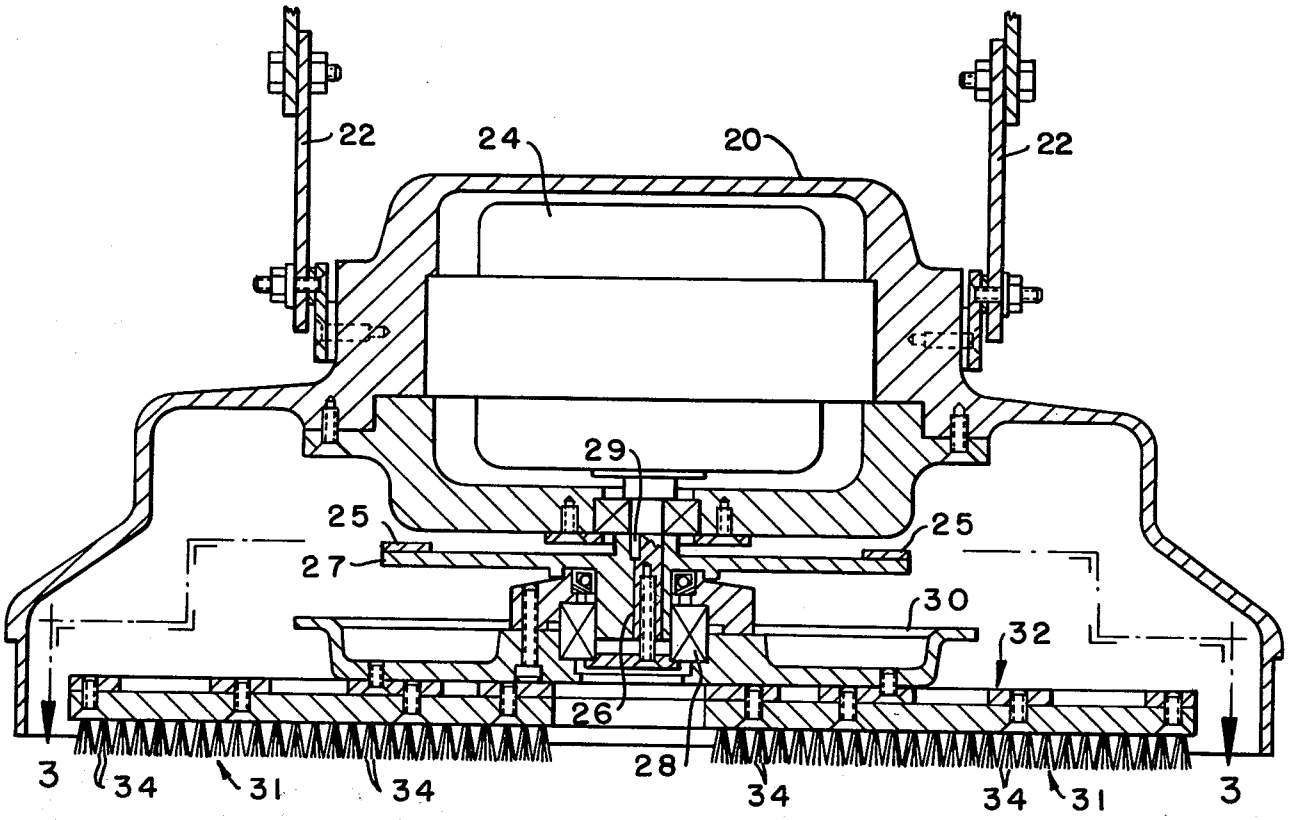
FIG. 2 is a schematic sectional view taken along section line 2—2 in FIG. 1.

As can be seen in FIGS. 1 and 2, housing 20 is pivotally mounted on frame 22. Handle 52 is connected to frame 22 and facilitates translating the machine across the carpet to be scrubbed. Vacuum means 54 is mounted on handle 52 and is connected to housing 20 by flexible hose 56. A powder dispenser of the type described in U.S. Pat. No. 4,019,662 is mounted on frame 22. This powder dispenser includes: a powder storage bin 36 supported by frame 22 above housing 20 near the front of the machine; rotating reticulated foam cylinder 38 rotatably mounted within powder storage bin 36 which presses against foraminous discharge area 40; and motor 42 for rotating reticulated foam cylinder 38. Door 44 is provided for sealing foraminous discharge area 40 and for serving as a ramp to aid in depositing powder in front of the machine as it translates over the carpet.

Wheels 23 are rotatably mounted at the lower rear of the frame 22 and partially support the weight of the machine in operation. The axis about which both wheels 23 rotate is parallel to the axis about which housing 20 is free to pivot. This arrangement prevents the housing from canting and insures that as the machine is translated over the carpet, the right side of the machine will be at the same height as the left side of the machine, thus promoting easier handling of the machine and uniform cleaning across the width of the path covered by the machine. However, since the weight of the device is supported by wheels 23 and scrubber element 32 and since housing 20 is free to pivot, carpets having piles of various lengths are automatically accommodated and housing 20 is free to follow the contour of the carpet. Wheel brushes 62 are mounted on frame 22 adjacent to wheels 23 to prevent accumulation of powder on wheels 23.

Figure 3:
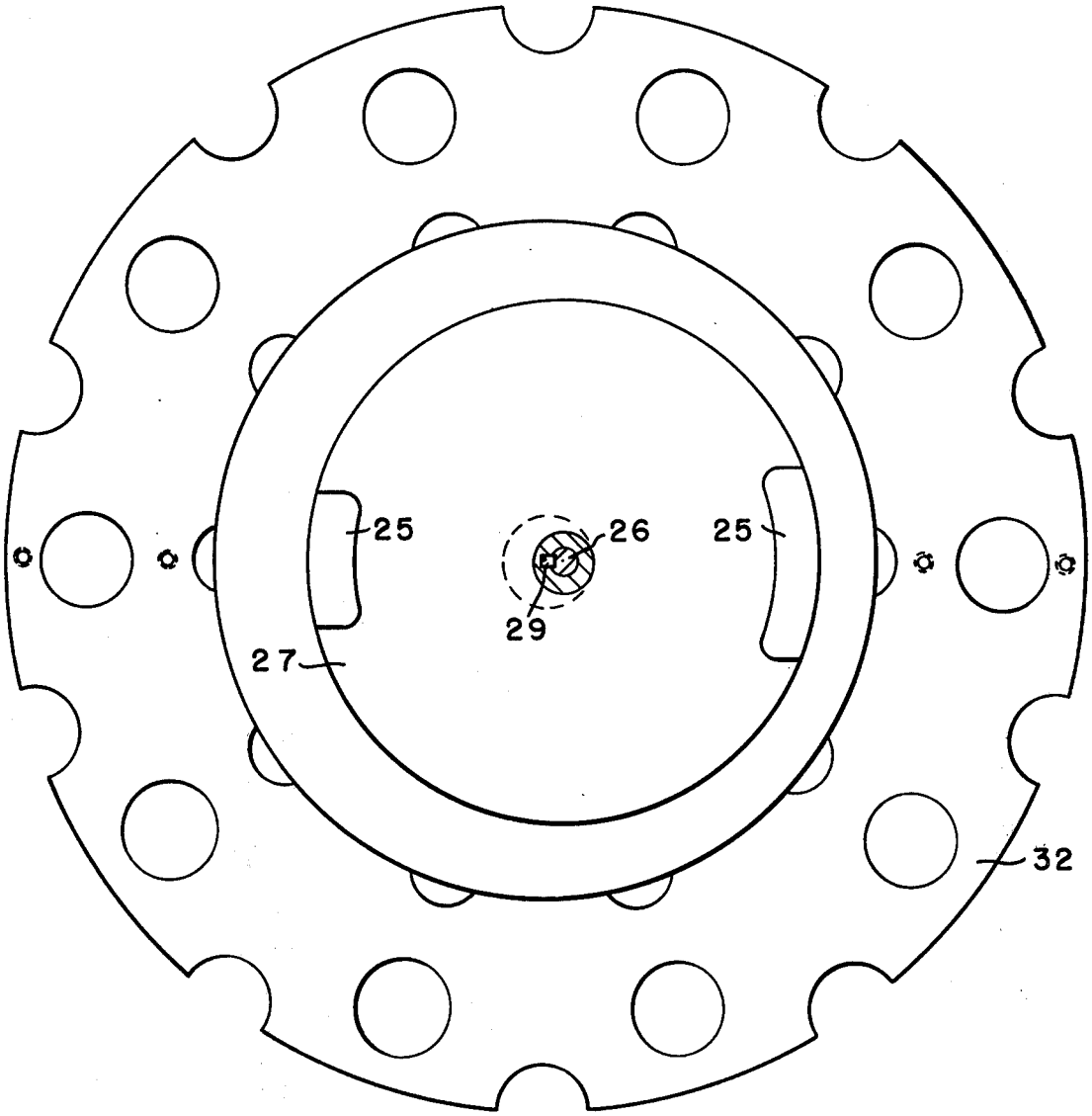
FIG. 3 is a sectional view taken along line 3—3 in FIG. 2.

As shown in FIG. 2, motor 24 having output shaft 26 is mounted vertically within housing 22. Eccentric support plate 27 encircles shaft 26 and also engages the inner race of bearing 28. Advantageously, as shown in FIG. 3, counterweights 25 may be mounted on eccentric support plate 27 to compensate for the unbalanced weight of the scrubber element 32. Slippage between eccentric support plate 27 and shaft 26 may be prevented by the inclusion of key 29 as shown in FIG. 2. The outer race of bearing 28 is fixed to scrubber support member 30 upon which scrubber element 32 is mounted. Scrubber element 32 has tufts 31 of bristles 34 which engage the carpet to be scrubbed and which together with wheels 23 support the weight of the machine.

As best shown in FIGS. 1 and 5, reticulated foam cylinder 38 is rotatably mounted in powder storage bin 36 and presses against foraminous discharge area 40 located at the lower front of the powder storage bin 36. Auxiliary motor 42 rotates reticulated foam cylinder 38 within powder storage bin 36. Activation of auxiliary motor 42 causes powder to be dispensed through foraminous discharge area 40. Storage bin door 44 is pivotably mounted on powder storage bin 36 and in closed position, it covers foraminous discharge area 40. Storage bin cover 46 is provided for the top of the storage bin and both powder storage bin door 44 and storage bin cover 46 provide moisture tight seals which retard the drying out of the powder stored within powder storage bin 36. In the open position, as shown in dotted lines in FIG. 5, storage bin door 44 serves as a ramp and aids in depositing powder in front of the machine as it translates over the carpet.

On many carpets, there is a tendency for brushes to redistribute the powder on the carpet. This effect is especially pronounced on low level loop carpets. It is thought that this redistribution of cleaning powder leads to uneven cleaning of the carpet and that a streaked appearance results therefrom. It is possible to reduce this redistribution by attaching pressing means to scrubber element 32 around its periphery. Such pressing means can include pressing members such as rider brushes **37*a* as shown in FIGS. 6 and 7 or flexible wipers 37*b* as shown in FIGS. 8 and 9**.

In the more preferred embodiments, as shown in FIGS. 10 through 16, tufts 31 of bristles 34 located in protruding areas 33 at the outer periphery of scrubber element 32 will function to press the powdered cleaning composition into the pile of the carpet and to minimize redistribution of powdered cleaning composition by scrubber element 32.

As shown in FIG. 11, the region of the lower face of the preferred brush 32 to which bristles 34 are applied has several protruding areas 33 around its periphery. Following the periphery of the bristled area from each protrusion 33 in the direction of rotation indicated by the arrow, it can be seen that the distance from the center of the brush to the outer edge of the bristled area increases steadily until the next protrusion 33 is encountered. As best shown in FIG. 12, the bristles are slanted at an angle of about 25° from the vertical but as can be seen in FIG. 2 are substantially perpendicular to the radial lines extending from the center of the brush. By applying bristles 34 to the lower face of brush 32 as described, it is possible to minimize the tendency of the brush to redistribute the powder which has previously been laid down on the carpet.

In operation as brush 32 orbits and rotates, tufts 31 in protruding area 33 will encounter particles which have been laid down on the carpet. Since the velocity of tufts 31 in each of protruding areas 33 which first encounter the particles of cleaning powder is approximately perpendicular to the edge of each bristled area, the tendency of tufts 31 to ride up over the particles and to press them down into the pile of the carpet is enhanced. In contrast when a circular brush is used, the velocity of the tufts which first encounter the particles of cleaning powder is substantially parallel to the edge of the bristled area. It is thought that this increases the tendency of the bristles to redistribute the powder.

Bristles 34 are inclined for two reasons. First, they facilitate the rotation of scrubber element 32 and the proper inclination makes it easier for protruding sections 33 to ride up over the powder and work them into the carpet. If motor 24 drives shaft 26 in the clockwise direction when viewed from the top, then bristles 34 should lean to the left when viewed from the front of the machine. However, if the opposite inclination is used, satisfactory results can be obtained but the device will be more difficult to control.

Figure 13:
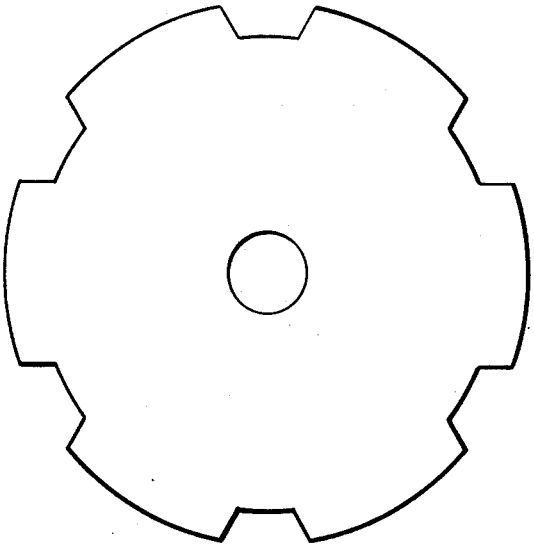
FIGS. 13 through 17 are schematic views of alternate configurations of the brush.
Figure 14:
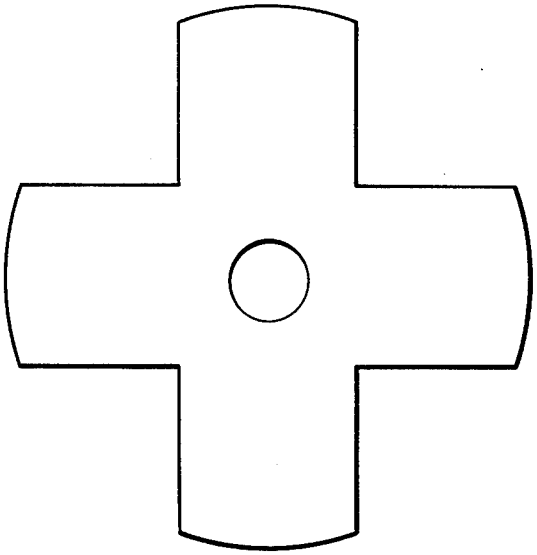
Figure 15:
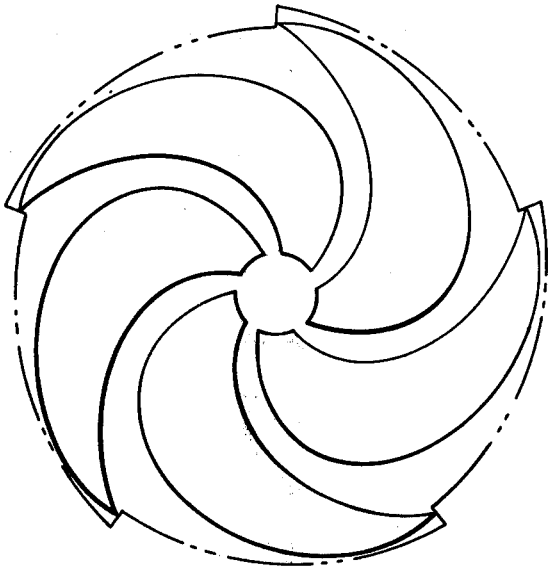
Figure 16:
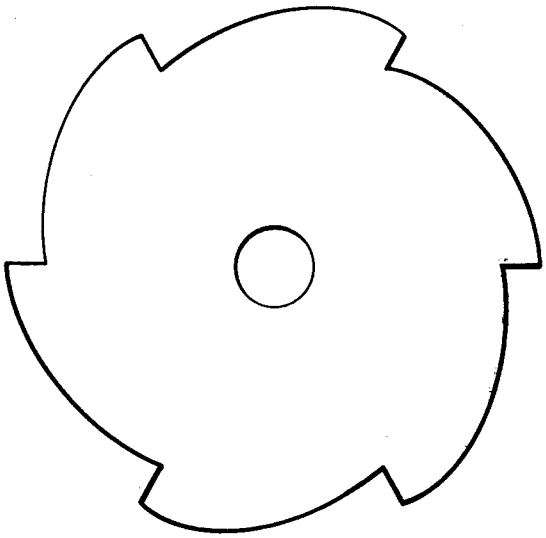
Figure 17:
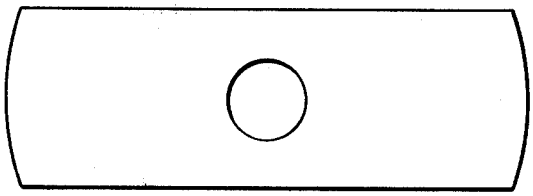

While the shape shown in FIG. 11 is the most preferred shape for the bristled area, other shapes such as those shown in FIGS. 13 through 17 are also quite suitable. FIG. 13 shows the shape of the bristled region on a brush having a gear shaped bristled region. FIG. 14 shows the shape of the bristled region on a brush having a cross shaped bristled region. FIG. 15 shows the shape of the bristled region on a brush having a fan blade shaped bristled region. FIG. 16 shows the shape of the bristled region on a brush having a saw blade shaped bristled region. FIG. 17 shows the shape of the bristled region on a brush having an oblong shaped bristled region. FIG. 16 differs from FIG. 11 principally in that there are five protrusions in FIG. 11 and six protrusions in FIG. 16. The shapes shown in FIGS. 11 and 16 are preferred because the presence of a plurality unobstructed tufts 35 located along a radial line at the edges of protrusions 33. Each unobstructed tuft is located so that an imaginary tangential line segment can be constructed which passes through the center of the tuft and meets the following conditions: the line segment is perpendicular to an imaginary radial line drawn through the center of the scrubber element to the center of the tuft; it extends in the direction of rotation of the scrubber element; it lies within the face of the scrubber element; and it does not pass through any portion of any other tuft or between any two other tufts which are adjacent to each other. Since the brushes shown in FIGS. 11 and 16 have a plurality of unobstructed bristles lying on a radial line, they are the most preferred embodiment of the invention, but other embodiments in which there are a plurality of unobstructed bristles which do not lie on the same radial line are acceptable.

By shaping the bristled region such that there are a number of unobstructed bristles, it is possible to reduce the tendency of the brush to redistribute powder. In the most preferred configuration, the unobstructed bristles will lie on a substantially radial line. By this combination of scrubber shape and bristle orientation, it is possible to minimize the tendency of the brush to redistribute the powder which has been laid down on the carpet.

Figure 4:
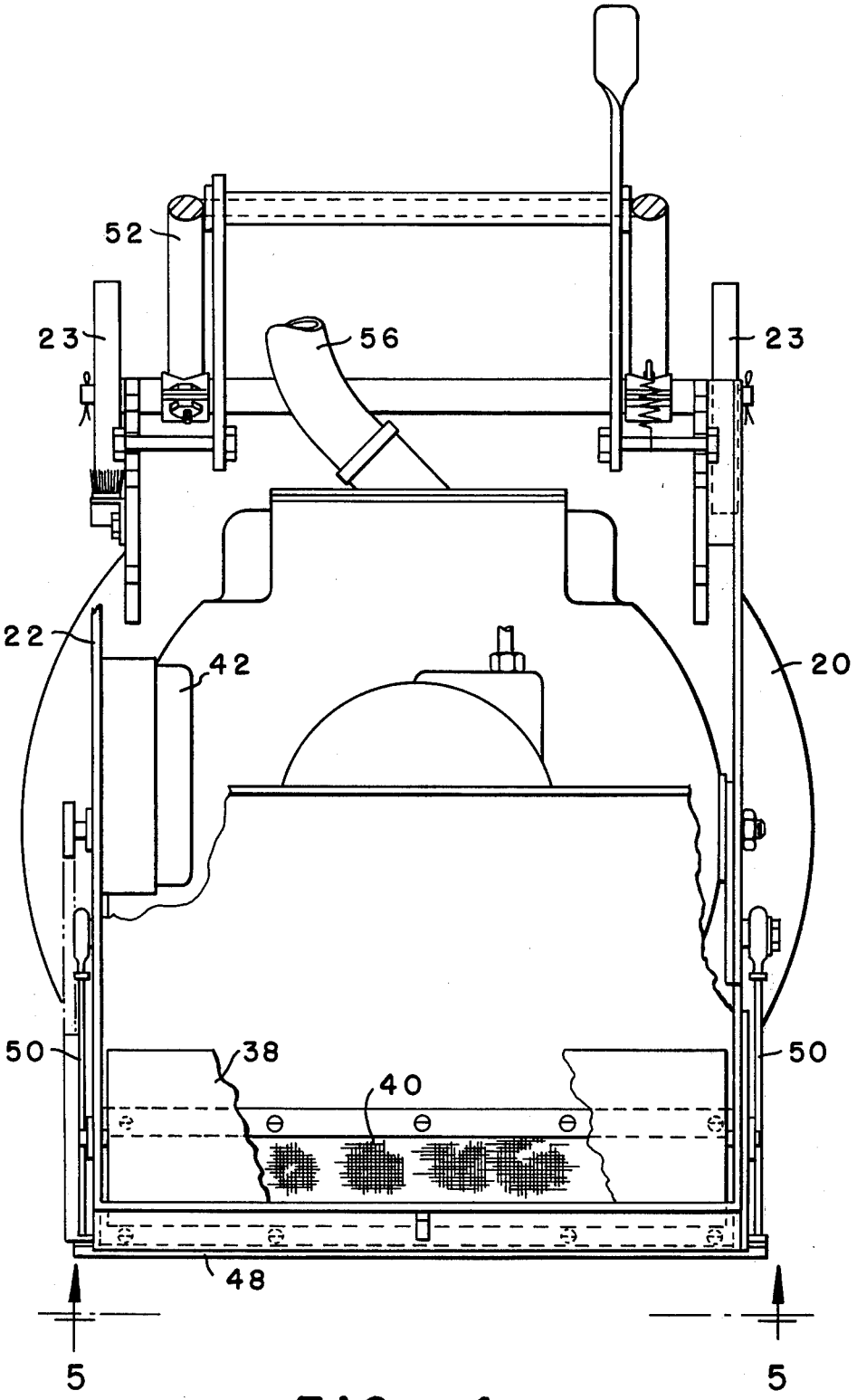
FIG. 4 is a partly cutaway top view of the carpet scrubbing machine.

In order to further minimize redistribution of powder, press bar 48 may be pivotably mounted on frame 22 by means of rods 50. As best shown in FIGS. 4, 5 and 10, each rod 50 terminates in a flattened portion 51 and tabs 49 are attached to each end of press bar 48. Each flattened portion 51 is pivotably connected to the corresponding tab portion 49 and each rod 50 is pivotably connected to frame 22 so that press bar 48 is free to follow the contour of the carpet. If press bar 48 is included, storage bin door 44 should be of sufficient length to insure that the powder will be deposited in front of press bar 48. In operation, as the scrubber is advanced over the carpet, powder will be dispensed in front of press bar 48 which minimizes redistribution of powder by pressing the powder into the pile of the carpet. Press bar 48 thus tends to immobilize the powder and may advantageously be included when use of the irregularly shaped brush is insufficient to reduce streaking to acceptable levels.

OPERATION

Upon activation of motor 24, shaft 26 is rotated. Since shaft 26 is fixed to eccentric support plate 27, the center of scrubber element 32 is driven in a circle. Since scrubber element 32 is free to rotate about its center it does not rotate at the same speed as shaft 26 but rather rotates more slowly. For example, in the most preferred embodiment, motor 24 will drive shaft 26 at 3400 rpm, scrubber element 32 will usually rotate at between 50 and 100 rpm depending upon the type of bristles used and on the type of carpet being scrubbed.

Upon activation of auxiliary motor 42, reticulated foam cylinder 38 is rotated. Particles of cleaning powder enter the pores of reticulated foam cylinder 38, are transported into contact with foraminous discharge area 40 where they are discharged onto storage bin door 44 which serves as a ramp and causes them to be deposited in front of housing 20.

If press bar 48 is included, the particles of cleaning powder are pushed into the pile of the rug by press bar 48 as the machine is translated over the carpet.

Whether or not press bar 48 is used, tufts 31 in the protruding areas 33 of scrubber element 32 encounter the particles of cleaning powder before the other tufts on scrubber element 32 and aid in pressing the powder down into the carpet. The remaining tufts 31 scrub the powder into the carpet. Vacuum means 54 prevents excessive dust from escaping from under housing 20.

I claim:

1. A device for cleaning carpets, comprising:

a frame;

a plurality of wheels rotatably mounted on said frame and partially supporting said device, said wheels being rotatable about the same axis of rotation;

a housing pivotably mounted on said frame, said housing being free to pivot about an axis which is substantially parallel to said carpet, and substantially parallel to the axis of rotation of said wheels;

a substantially vertical shaft rotatable supported by said housing;

means for rotating said shaft;

an orbiting scrubber element rotatably mounted on said shaft, said scrubber element being rotatable about an axis which is substantially parallel to but offset from the axis of rotation of said vertical shaft; said scrubber element supporting the remainder of the weight of the device;

means mounted on said frame for spreading coherent powder on said carpet; and means for pressing said powdered cleaning composition into said carpet before said powder encounters said scrubber element as said machine translates over said carpet, said means including a horizontal pressing member mounted on said frame and means for holding said pressing member in contact with said carpet.

2. The device of claim 1 wherein said means for spreading coherent powder includes:

a powder storage bin mounted on said frame having a foraminous discharge area;

a cylinder of pore bearing resilient reticulated foam rotatably mounted within said bin and disposed such that on rotating, it presses against said foraminous discharge area forcing said powder through said perforations; and, means for rotating said cylinder.

3. A device for scrubbing carpets, using powdered cleaning composition, comprising:

a frame;

scrubbing means rotatably mounted on said frame for agitating powdered cleaning composition in the pile of said carpet; and means mounted on said frame for pressing powdered cleaning composition into the pile of said carpet prior to action thereupon by said scrubbing means.

4. The device of claim 3 further comprising means mounted on said frame for dispensing powdered cleaning composition forward of said means for pressing powdered cleaning composition into the pile of said carpet.

5. The device of claim 3 wherein said means for pressing powdered cleaning composition into the pile of said carpet includes a horizontal pressing member and means urging said pressing member into contact with said carpet.

* * * * *